US006095045A

United States Patent [19]

Petersen et al.

[11] Patent Number: 6,095,045

[45] Date of Patent: Aug. 1, 2000

[54] DEVICE FOR FILLING DEPRESSIONS IN A CYLINDER; DOCTOR BLADE DEVICE FOR THIS PURPOSE AND PROCESS FOR CHANGING IT

[75] Inventors: Godber Petersen; Hans Fleischmann; Rainer Stamme, all of Augsburg, Germany

[73] Assignee: MAN Roland Druckmaschinen AG, Offenbach am Main, Germany

[21] Appl. No.: 08/878,927

[22] Filed: Jun. 19, 1997

[30] Foreign Application Priority Data

Jun. 19, 1996 [DE] Germany ..... 196 24 440

[51] Int. Cl.[7] ..... B41F 31/00; B41F 31/02

[52] U.S. Cl. ..... 101/350.6; 101/366

[58] Field of Search ..... 101/366, 157, 101/169, 365, 363, 364, 207–210, 350.1, 350.5, 351.1, 351.4, 352.01, 161, 202, 205, 329, 348, 349.1, 350.6; 118/261, 263

[56] References Cited

U.S. PATENT DOCUMENTS

| | | | |
|---|---|---|---|
| 1,814,024 | 7/1931 | Debus . | |
| 2,018,193 | 10/1935 | Smith . | |
| 2,506,011 | 5/1950 | Caulfield | 101/153 |
| 3,333,535 | 8/1967 | Behringer | 101/157 |
| 5,184,556 | 2/1993 | Schaeuble | 101/366 X |
| 5,239,925 | 8/1993 | Bobo . | |

FOREIGN PATENT DOCUMENTS

| | | |
|---|---|---|
| 1 279 525 | 1/1991 | Canada . |
| 556 460 | 8/1993 | European Pat. Off. . |
| 638 419 | 2/1995 | European Pat. Off. . |
| 358 874 | 9/1922 | Germany . |
| 730 035 | 1/1943 | Germany . |
| 2 411 771 | 9/1974 | Germany . |
| 39 11 839 | 10/1990 | Germany . |
| 42 08 295 | 9/1993 | Germany . |
| 43 20 833 | 9/1994 | Germany . |
| 50-31494 | 10/1975 | Japan . |
| 51-12731 | 1/1976 | Japan . |
| 7-89056 | 4/1995 | Japan . |

*Primary Examiner*—Kimberly Asher
*Attorney, Agent, or Firm*—Cohen, Pontani, Lieberman & Pavane

[57] ABSTRACT

A device for filling depressions in a cylinder of a printing machine with a fluid, e.g., an ink, which permits a quick change to a different fluid, includes at least two doctor blade devices arranged on the cylinder which doctor blade devices can be selectively moved individually into effective connection with the cylinder.

12 Claims, 8 Drawing Sheets

DEVICE FOR FILLING DEPRESSIONS IN A CYLINDER; DOCTOR BLADE DEVICE FOR THIS PURPOSE AND PROCESS FOR CHANGING IT

BACKGROUND OF THE INVENTION

1. Field of the Invention

The invention relates to a device for filling the depressions in a cylinder of a printing machine (e.g., a screen roller) with a fluid. The invention also relates to a doctor blade device especially suited for this purpose, as well as to a process for changing the doctor blade device.

2. Discussion of the Prior Art

It is becoming increasingly important for printing machines to have, along with flexibility in web guidance, the capacity to change ink colors rapidly between printing jobs. Four-color printing machines, for example, must frequently be converted from a four-color printing mode with one web to a one-color printing mode with four webs. To minimize down time, such conversions must be carried out as quickly as possible. Conversion time is especially costly when printing machines are used for small runs e.g., when there are frequent changes in the type of production. Such printing machines include those connected to data networks for the decentralized printing of small runs. Printing machines of this type are described, for example, in German Patent Application DE 196 24 395.5. One time-consuming task in converting a printing machine is cleaning the inking unit.

German reference DE 39 11 839 A1 discloses what is known as a "rinse inking unit" for inking a screen roller. In this device, an inking channel is arranged below the screen roller. On both sides of the inking channel, doctor blades rest on the screen roller. Changing the ink in this device would require a time-consuming process of cleaning and exchange.

SUMMARY OF THE INVENTION

It is an object of the present invention is to provide a device for filling the depressions in a cylinder of a printing machine with a fluid, which device permits a quick change to a different fluid. A further object of the invention is to provide a doctor blade device for filling the depressions that is especially suitable for this purpose. Yet another object is to provide a process for changing the doctor blade device.

Pursuant to these objects, and others which will become apparent hereafter, one aspect of the present invention resides in a device for filling depressions of a cylinder of a printing machine with a fluid, which device includes at least two doctor blade devices configured to be selectively and individually movable into effective connection with the cylinder. In another embodiment of the invention one of the doctor blade devices is configured for filling a solidifiable fluid and another of the doctor blade devices is configured for filling ink into the depressions of the cylinder.

Another aspect of the invention resides in a doctor blade device for filling the depressions, which doctor blade device includes ink application means, a conveyance system for conveying fluid to the application means, a working blade arranged after the application means in a rotational direction of the cylinder, and means for moving the application means away from the cylinder independently of the working blade so that fluid can flow out of the application means when the application means is in a position away from the cylinder.

In another embodiment of the invention the application means includes a first doctor blade positioned positively and laterally on the cylinder so as to form a wedge-shaped first region that holds the fluid. The wedge-shaped first region is bordered by the doctor blade and a cylindrical surface of the cylinder.

A further embodiment of the invention provides a second doctor blade mounted in front of the first doctor blade in the rotational direction of the cylinder so as to define a second region. The second doctor blade has bores distributed along its length so as to place the second region and the first region in fluid communication.

In another embodiment of the invention the first region is operated at a slight overpressure of the fluid. Overflow ducts are in fluid communication with the second region and a collection basin so that the fluid can flow into the collection basin.

Still another embodiment of the invention provides two sealing plates. Each of the sealing plates is movably arranged to rest against a respective end face of the first doctor blade. Spring means are provided for pressing the sealing plates toward the respective end face. Bolts are arranged so that the sealing plates rest against the bolts and the first doctor blade with a 3-point support.

A further embodiment of the invention includes two working cylinders operatively connected to respective ones of the sealing plates so that the sealing plates can be moved toward and away from the cylinder. Flat surface members are arranged to guide the sealing plates with play during positioning movement toward the cylinder so as to permit centering of the sealing plates on the surface curvature of the cylinder.

In yet another embodiment of the invention the application means is configured to be moveable in a longitudinal direction of the cylinder out of the cylinder surface region of the cylinder.

Still another embodiment of the invention provides a first holder and a second holder arranged to hold respective sides of the application means and the working blade. A side wall is provided having a support member mounted thereto and a support tube mounted to the side wall and the support member. A spindle is mounted movably in the support tube. The first holder is movably arranged on the support tube and the second holder is attached to the spindle.

Still yet another embodiment of the invention provides means for oscillating the device. The oscillating means includes a working cylinder that rests on the support member and has a piston rod connected detachably to the second holder.

By moving one doctor blade device out of position (i.e., away from the cylinder) and another doctor blade device into position on the cylinder, it is possible to change rapidly to a different filling fluid. When this is done, no intervening cleaning step is needed. Furthermore, a specially proposed doctor blade device is automatically emptied when moved out of position, making cleaning unnecessary. In addition, the working blade that remains on the cylinder after the application mechanism of the doctor blade device has been moved away cleans the cylinder. This doctor blade device is well-suited for imaging a printing form of a printing machine for the "computer-to-press" method; for example, using the gravure printing/UV ink process described in German reference DE 196 24 441.2.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENT

Figure 1:
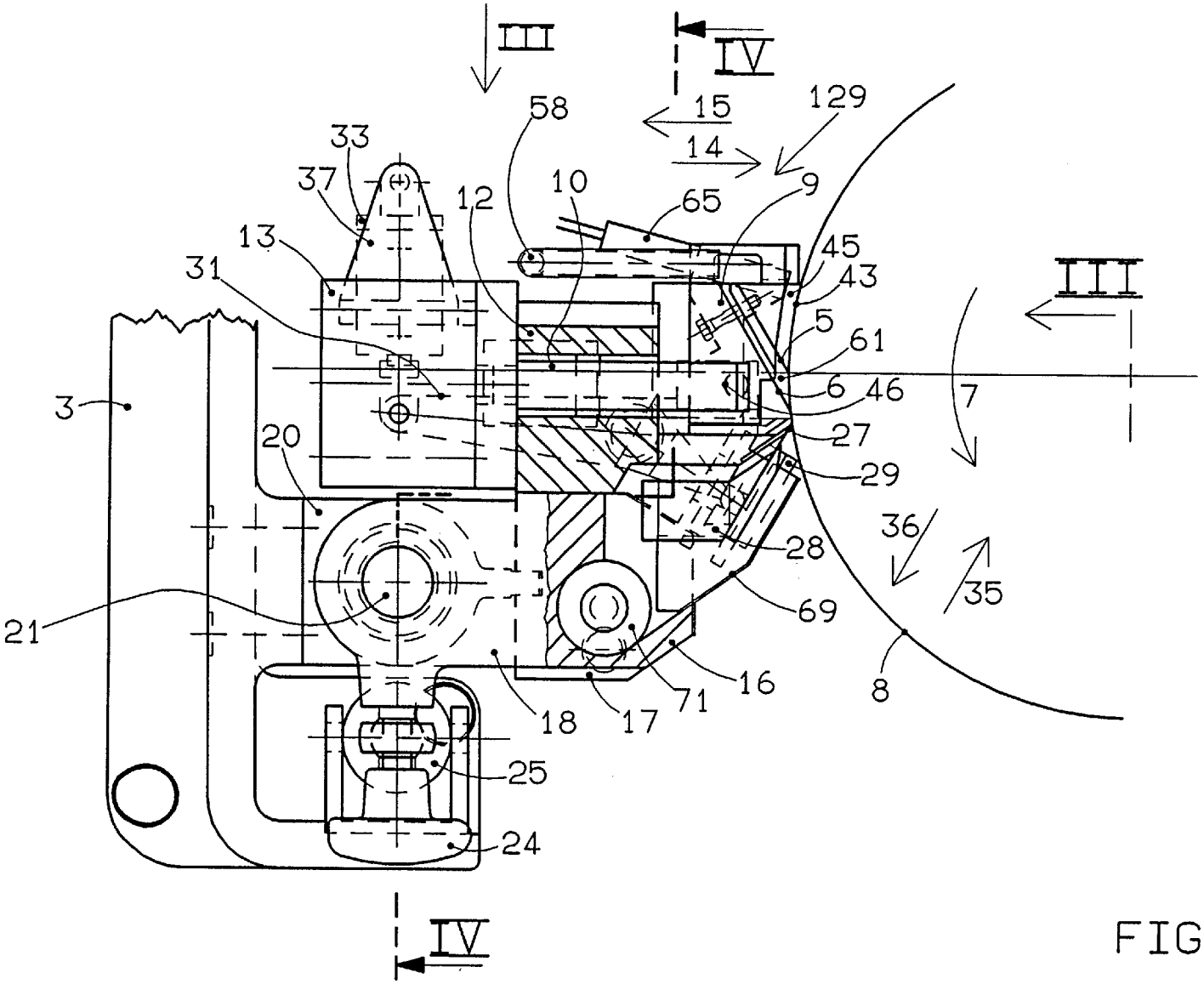
FIG. 1 shows a doctor blade device pursuant to the present invention, in partial section.
Figure 4:
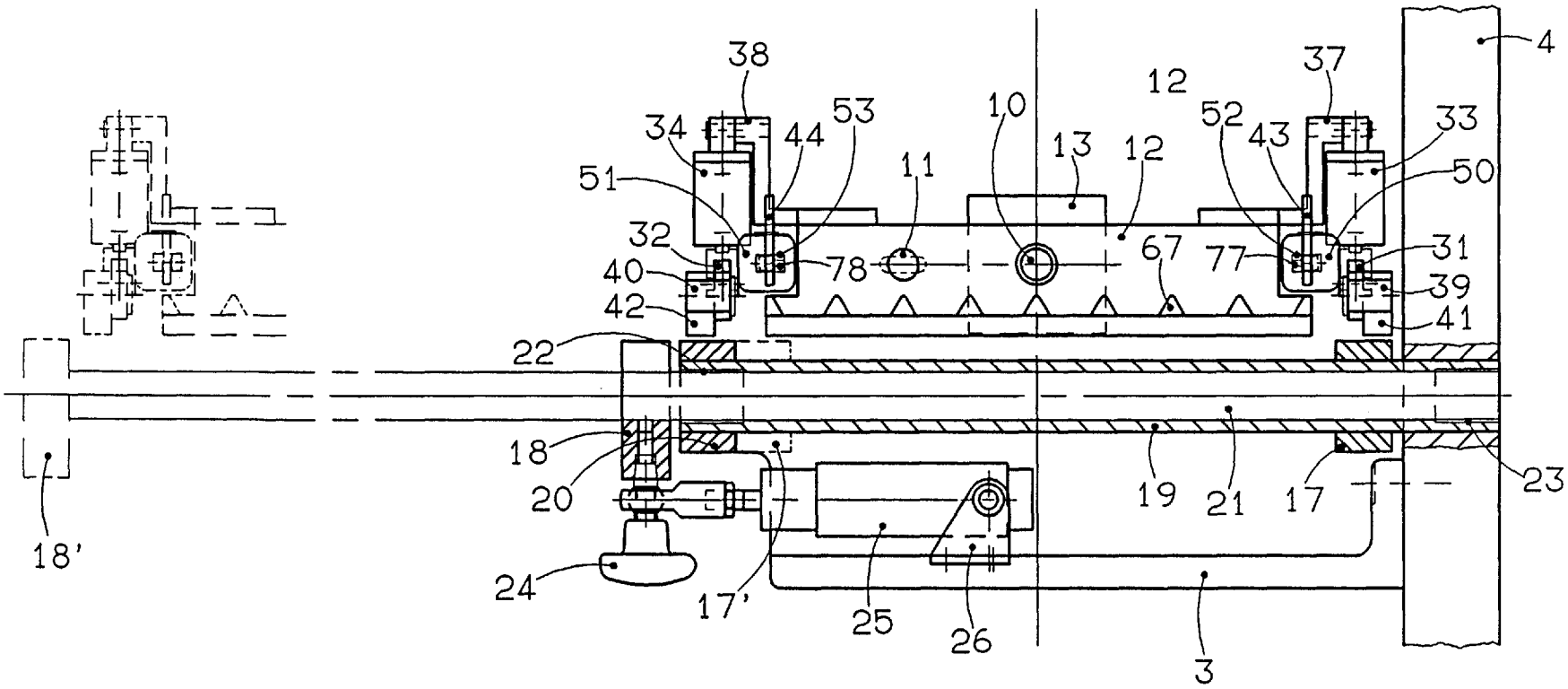
FIG. 4 is a section along line IV—IV in FIG. 1.

The doctor blade device shown in FIG. 1 is attached to the side wall 4 of a printing machine by a support 3. The doctor blade device contains an application mechanism 129, which has a first doctor blade 6 and a second doctor blade 5, as well as a working blade 27. The doctor blades 5, 6 are positioned positively on the cylinder to be inked (here, a form cylinder 8). This means that the doctor blades 5, 6 point in the rotational direction 7 of the form cylinder 8. The doctor blades 5, 6 are arranged laterally on the form cylinder 8. The blades 5, 6 are attached to a carrier 9, which is mounted by guides 10, 11 in a support 12. The carrier 9 can be moved by means of a working cylinder 13 in the direction of the arrows 14, 15, i.e., toward and away from the form cylinder 8. The support 12, in turn, is attached to a carrier 16, which is supported by holders 17, 18 on a support tube 19. One end of the support tube 19 is attached to the side wall 4, while the other end is supported by a holder 20 on the support 3 (FIG. 4). At its front side, the carrier 16 is attached by the holder 18 to a spindle 21, which is mounted by guides 22, 23 in the support tube 19. As a result, the spindle 21 can be withdrawn from the support tube 19 telescopically, so that the holder 18 can be moved into the position 18' shown by the dashed-dotted line (FIG. 4). Similarly, the holder 17 then slides on the support tube 19 into the position 17'. In this way, the entire doctor blade device can be moved parallel to the form cylinder 8, so as to achieve a servicing position in front of the latter. In this servicing position, worn parts, e.g., the doctor blades 5, 6, can be easily exchanged. Before the doctor blade device is moved, the grip 24, which connects a working cylinder 25 to the holder 18, must be detached. The working cylinder 25 is supported by a holder 26 on the support 3 and is used, in a known manner, for the purpose of oscillation, i.e., to move the doctor blade device back and forth axially by a certain stroke.

Figure 5:
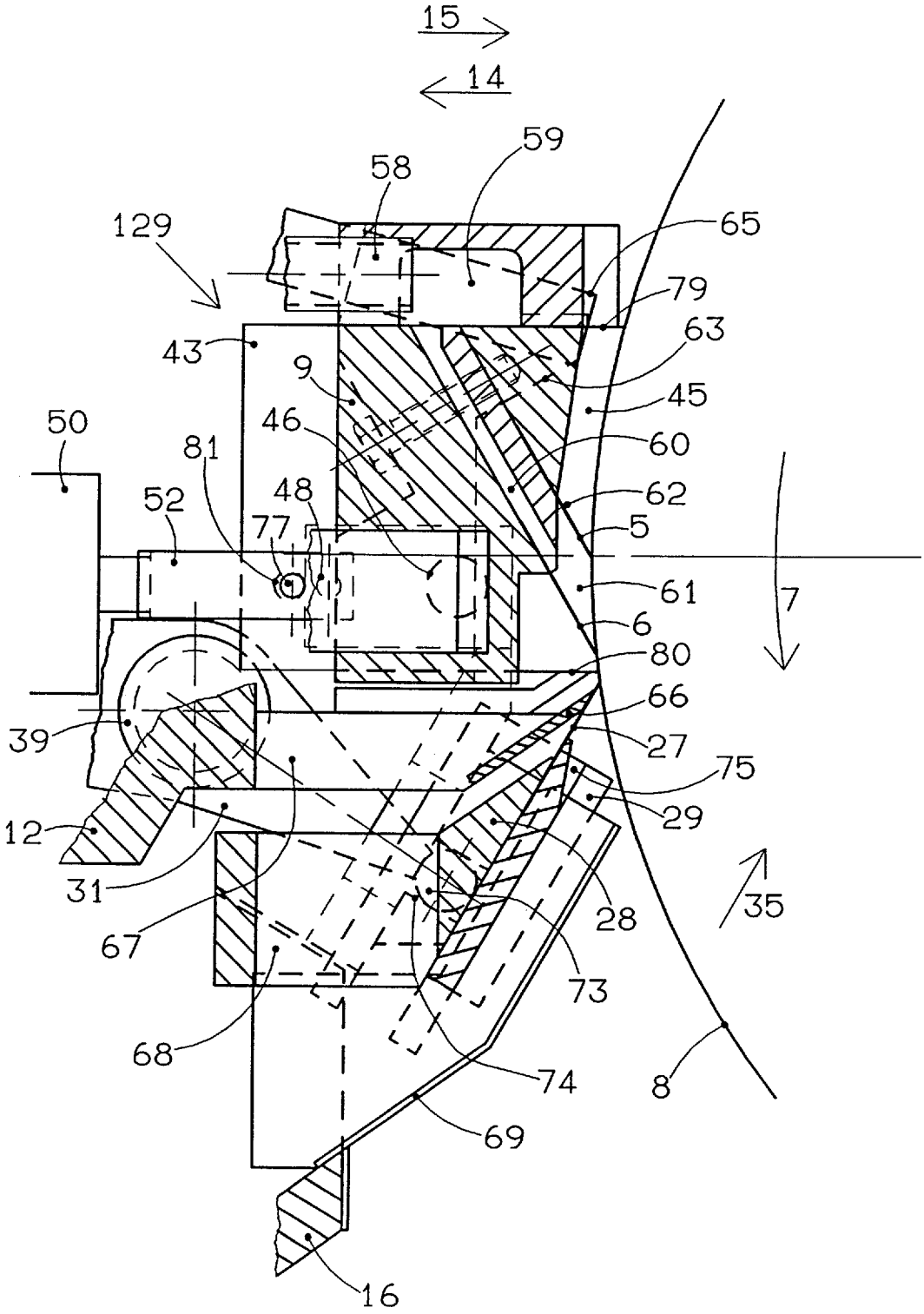
FIG. 5 is an enlarged section from FIG. 1.

The working blade 27 is positioned negatively on the form cylinder 8 (i.e., opposite to its rotational direction 7) below the doctor blade 6 and at a slight distance from it (FIG. 5). The working blade 27 is attached to a carrier 28, which can be moved in guides 29, 30 by means of working cylinders 33, 34 via levers 31, 32 in the direction of the arrows 35 and 36. The working cylinders 33, 34 are attached to the support 12 by holders 37, 38, while the levers 31, 32 are rotatably attached by bolts 39, 40 and holders 41, 42 to the holders 17, 18.

Figure 2:
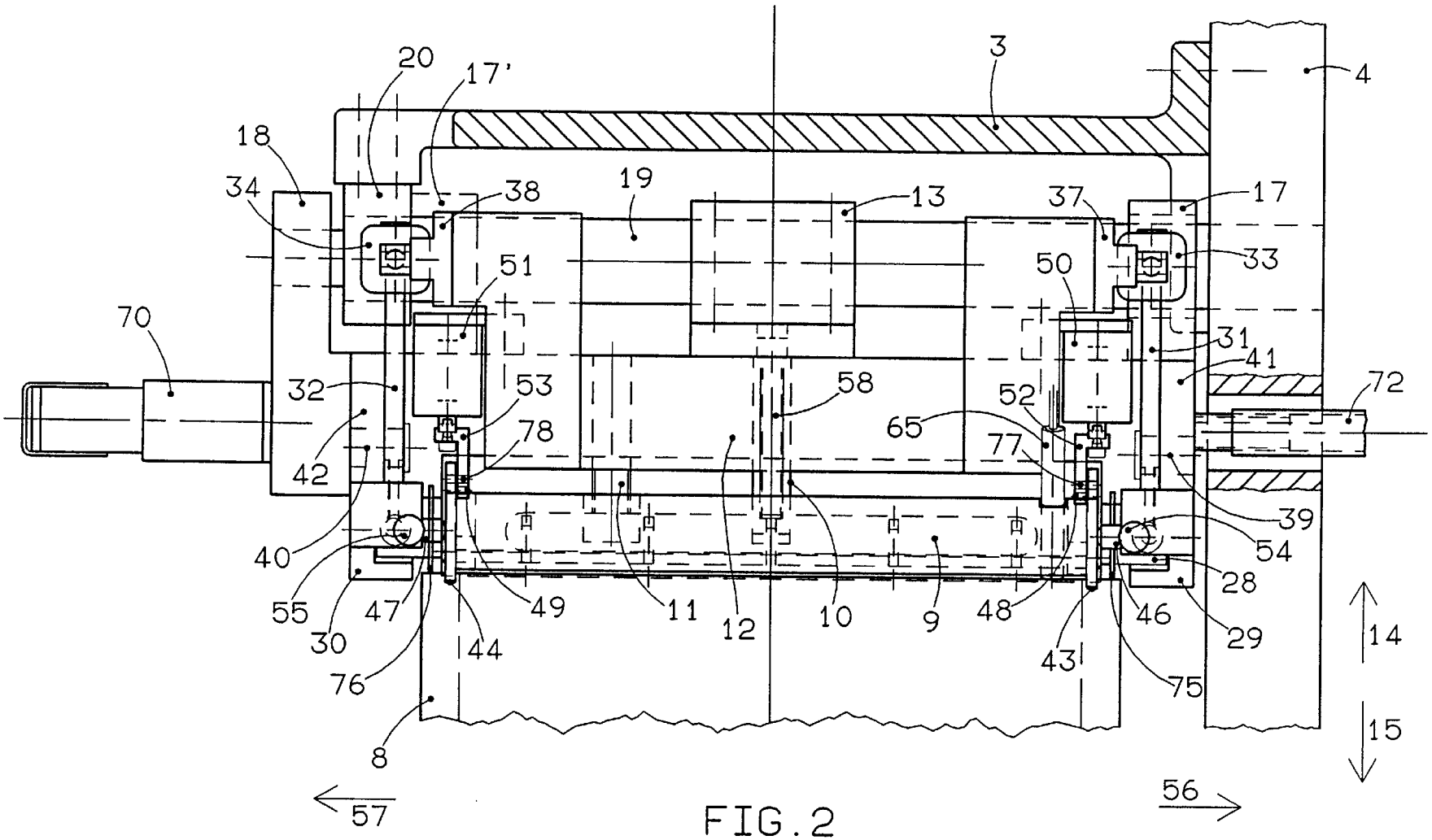
FIG. 2 is a top view in Direction II as in FIG. 1.

The doctor blade 6 forms, with the cylindrical surface of the cylinder 8, a first wedge-shaped region 61. The doctor blade 5 forms, with the cylindrical surface of the cylinder 8, a second wedge-shaped region 45, which is open at the top. The two regions 45, 61, are bordered longitudinally by the respective sealing plates 43, 44, which rest on the faces of the doctor blade 6. The two sealing plates 43, 44 also rest on the bolts 48, 49, achieving a three-point support, and are pressed by spring-loaded bolts 46, 47 against the end faces of the doctor blade 6 and the bolts 48, 49. The sealing plates 43, 44 can be moved in the directions 14, 15 by working cylinders 50, 51 (FIG. 2) via drivers 52, 53. For easy removal of the sealing plates 43, 44, the bolts 46, 47 can be moved via levers 54, 55 in the directions 56, 57 counter to the spring forces.

Figure 3:
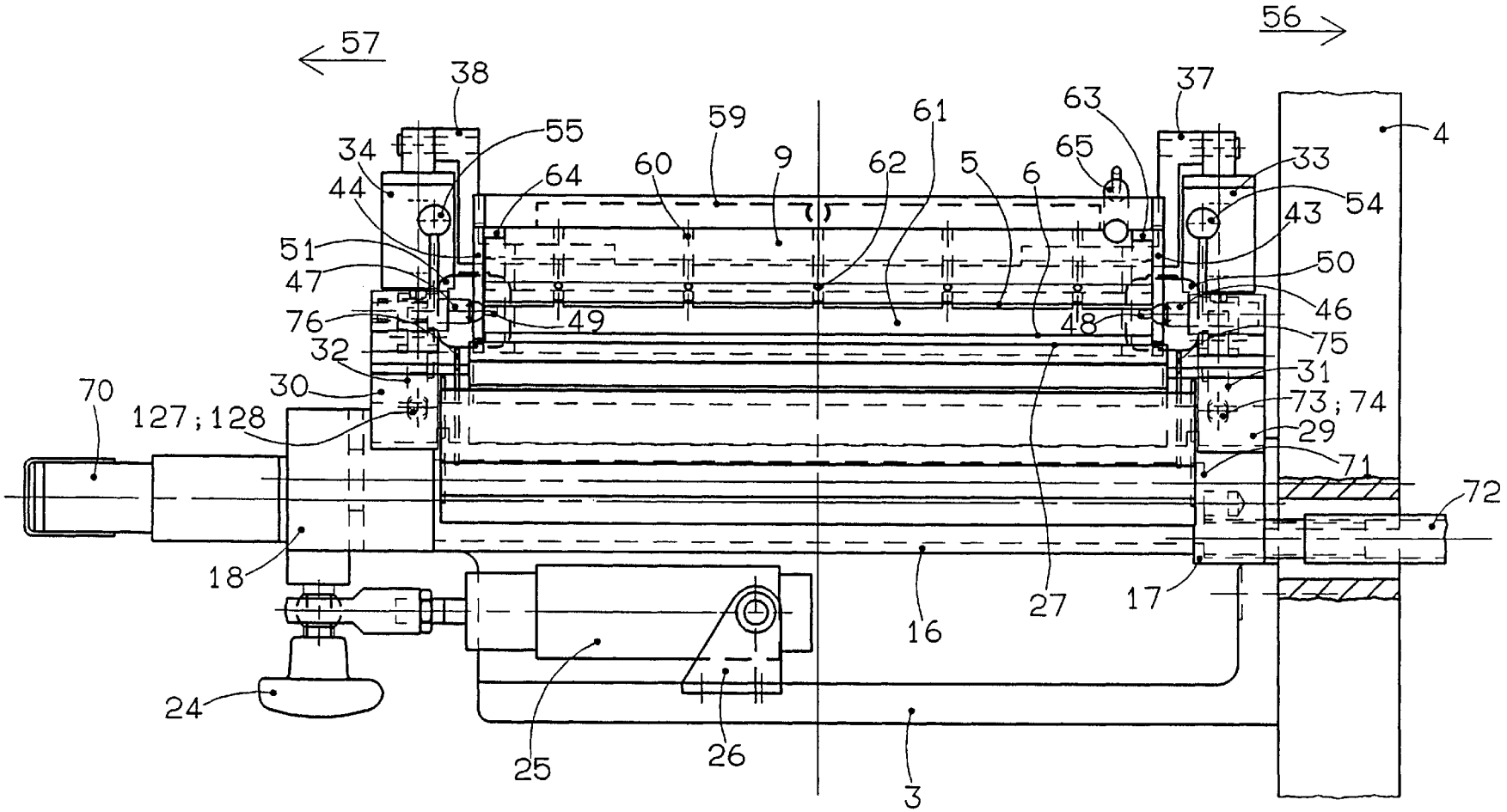
FIG. 3 is a view in Direction III as in FIG. 1.

The function of the doctor blade device is described below in reference to FIGS. 5 and 6. The printing ink for inking the cups of a gravure printing form that is carried by the form cylinder 8 is supplied under pressure through a tube 58 and forced through the duct 59 and the duct 60 into the first region 61 between the doctor blades 5, 6. The printing ink then passes through bores 62, which are distributed along the length of the doctor blade 5, into the second region 45, and fills it. Overflow ducts 63, 64 prevent the ink from overflowing the sealing plates 43, 44 (FIG. 3). The fill level of the ink can be detected by a sensor 65 and reported to an ink supply control device, which is explained below.

When the form cylinder 8 is rotated in the direction 7, the cups of the form cylinder 8 are filled with ink in the known manner in the region 45, as FIG. 5 shows. Enclosed air bubbles are extracted from the cups by means of the cavitation that occurs on the doctor blade 5, so that the cups can be completely filled by means of the slight overpressure in the region 61 (depending on the viscosity of the ink up to approximately 2 bar) and the hydrodynamic effect of the doctor blade 6. The cylinder surface is then wiped clean by a working blade 27, which is supported by a rod 66, which in turn is attached to support fingers 67 of the support 12. The wiped-off ink is then able to flow between the support fingers 67 and through bores 68 in the carrier 28 into a collection basin 69. Here, a conveyor screw 71 driven by a motor 70 ensures that the ink is transported back through a hose 72 to an ink supply unit. During this inking procedure, as described above, the doctor blades 5, 6 are pressed in the direction 15 toward the surface of the form cylinder 8 by the working cylinder 13 via the carrier 9, while the working blade 27 is pressed in the direction 35 toward the cylinder surface by the working cylinders 33, 34 via the levers 31, 32 and the carrier 28. At their ends, the levers 31, 32 have balls 73, 127 which are carried along in the respective cylindrical bores 74, 128 in the carrier 28. As a result, the carrier 28 can be pivoted around the ball midpoints, and thus can always optionally position the doctor blade 6 onto the cylinder surface. Disks 75, 76 attached to the carrier 28 prevent ink from flowing into the region of the guides 29, 30.

FIG. 5 also shows that the sealing plates 43, 44, when pressed in the direction 15 toward the cylinder surface by the working cylinders 50, 51 via the drivers 52, 53 and the driver pins 77, 78, are supported on surfaces 79, 80. Because these surfaces 79, 80 are located near the cylinder surface and because the driver pins 77, 78 simultaneously engage, with play, in bores 81 in the sealing plates 43, 44, it is possible for the sealing plates 43, 44 to be centered on the surface curvature of the form cylinder 8 by a slight tilting movement under pressure of the working cylinder 50, 51. This centering option is advantageous when the position of the form cylinder 8 changes, e.g., to compensate for various thicknesses of the printing stock.

Figure 6:
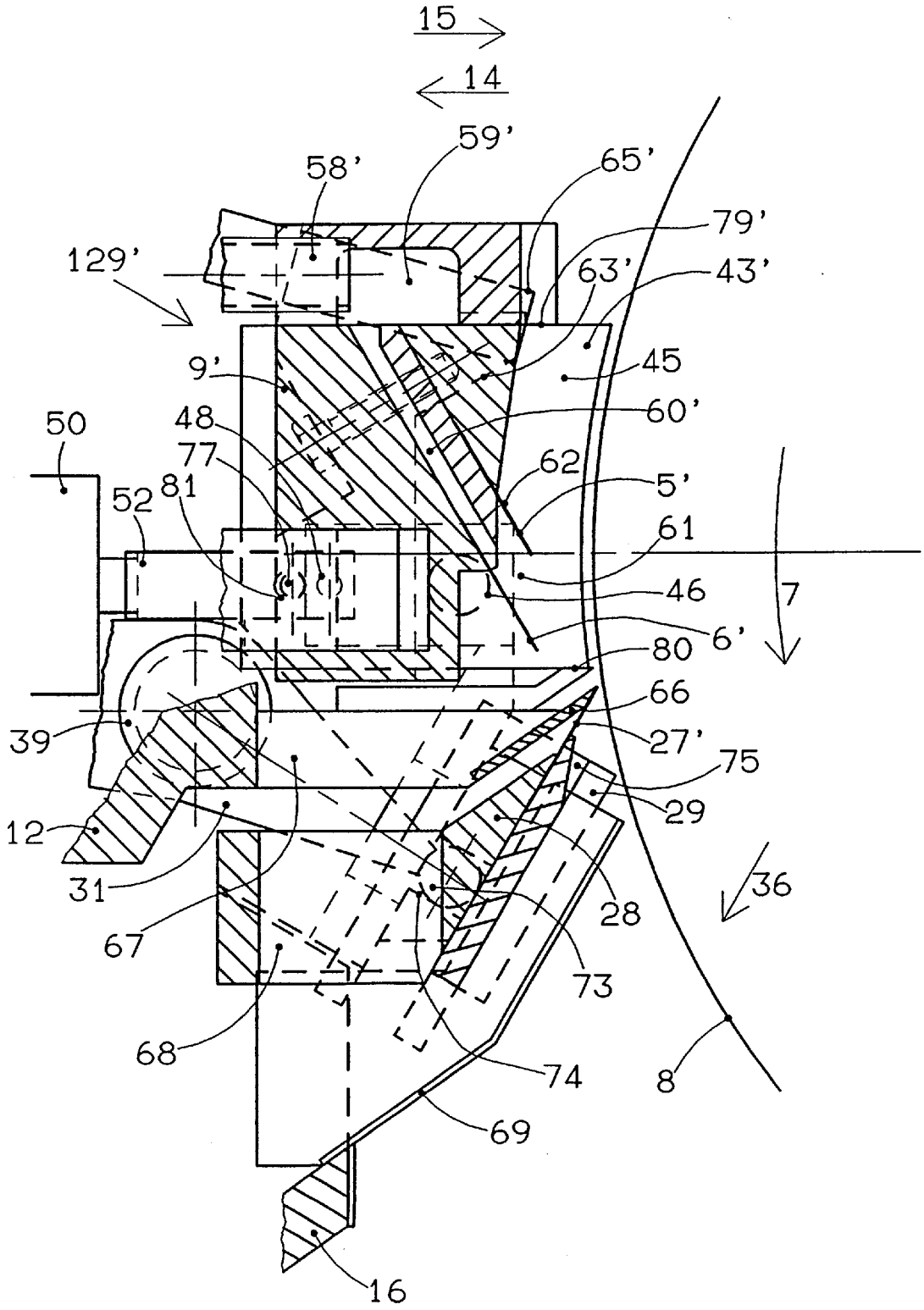
FIG. 6 shows the elements of FIG. 5 in the a position removed from the cylinder.

FIG. 6 shows the doctor blade device in a position away from the form cylinder 8. After the ink supply is stopped, the doctor blades 5, 6 are moved away from the cylinder surface in the direction 14 by means of the working cylinder 13 and then assume the positions 5', 6'. In addition, the sealing plates 43, 44 are moved away from the surface of the form cylinder 8 by means of the working cylinders 50, 51 and assume the positions 43', 44'. The ink is now able to flow out of the spaces 45, 61 and be captured in the collection basin 69. The working blade 27 remains on the form cylinder 8 in the position shown in FIG. 5 until the ink flows out of the spaces 45, 61 and the surface of the form cylinder 8, after several rotations of the cylinder, is wiped clean. Then the working blade 27 is withdrawn in the direction 36 into the position 27' shown in FIG. 6. A cleanly wiped cylinder surface is then available for subsequent work procedures, such as imaging or cleaning.

The doctor blade device can also be arranged more or less underneath the form cylinder 8. In this case, however, any second space 45 must be embodied with a longitudinal wall. Furthermore, measures must be taken to ensure that when the doctor blade device is moved out of position, the spaces 45, 61 empty. This can be done, for example, by opening the ink line.

Figure 7:
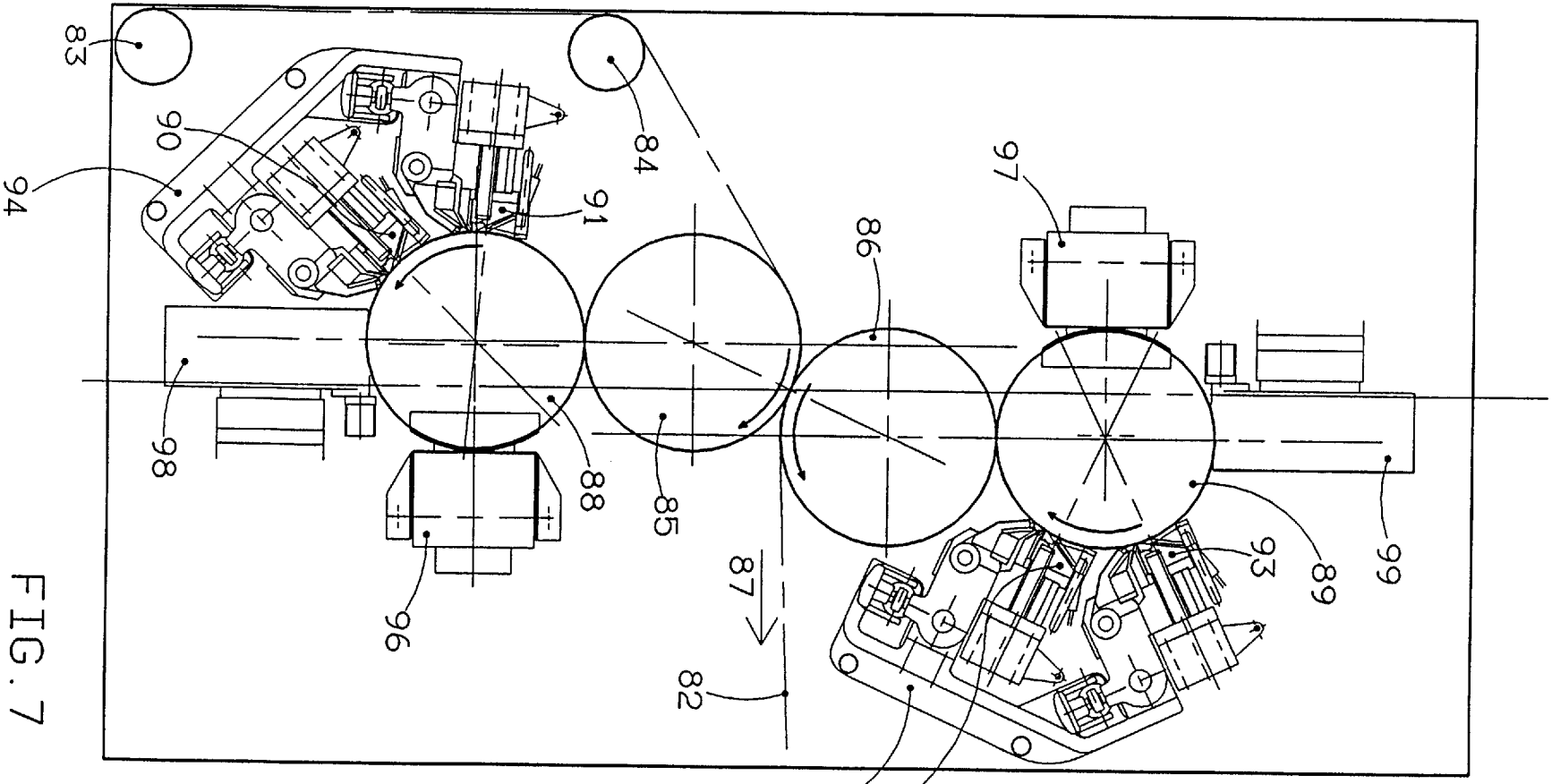
FIG. 7 shows a double printing group with doctor blade devices.

FIG. 7 shows a side view of a double printing group with doctor blade devices. A web 82 to be printed is run via rollers 83, 84 between transfer cylinders 85, 86 positioned against one another. The transfer cylinders 85, 86 take the printing image from the form cylinders 88, 89 and transfer the image to both sides of the web 82 running in the direction 87. This drawing shows a UV/computer-to-press method of indirect gravure printing, as described in German reference DE 196 24 441.2. Each of the form cylinders 88, 89 has associated with it two doctor blade devices 90, 91 or 92, 93, whose structures correspond to the doctor blade device described above. In each case, the two doctor blade devices 90, 91 or 92, 93 are supported with one support 94, 95 in a float mounting. In the illustrated embodiment, the cups of the form cylinders 88, 89 are filled with black ink by the doctor blade devices 91, 93, using the UV driers 96, 97, by several cylinder rotations. After this, the doctor blade devices 91, 93 are moved away and the form cylinders 88, 89 are imaged with the help of laser heads 98, 99. If printing is to be carried out with black ink, the doctor blade devices 91, 93 filled with black ink are then moved back into position for the printing process. If colored ink is to be used, the doctor blade devices 90, 92 filled with colored ink are moved into position. In this way, it is possible to quickly implement ink changes, even those required when the web guidance is changed for the purpose of producing different printed products, e.g., small runs.

The described doctor blade devices can also be used when the depressions in a cylinder are to be filled with a different fluid; for example, when a printing form is to be produced on a form cylinder not with UV solidifiable ink, but with a filler substance solidified in a different manner. For instance, on the form cylinder 88, in addition to the doctor blade devices 90, 91 for printing with colored or black ink (not shown), it is also possible to provide a doctor blade device for applying a special filler substance for form production. The doctor blade devices can also be used for conventional gravure printing, for gravure printing with water-based ink, for inking screen rollers per se, e.g., anilox rollers, and for other purposes. Of course, the invention also encompasses equivalents of the embodied examples. For instance, instead of the working cylinders 13, 33, 34, 50, 51, which can be driven hydraulically or pneumatically, it is possible to use electrical lifting magnets, as applicable, in conjunction with return springs. The application mechanism 129 can also function with only one doctor blade, for example, or with a chamber blade or a nozzle application system.

Figure 8:
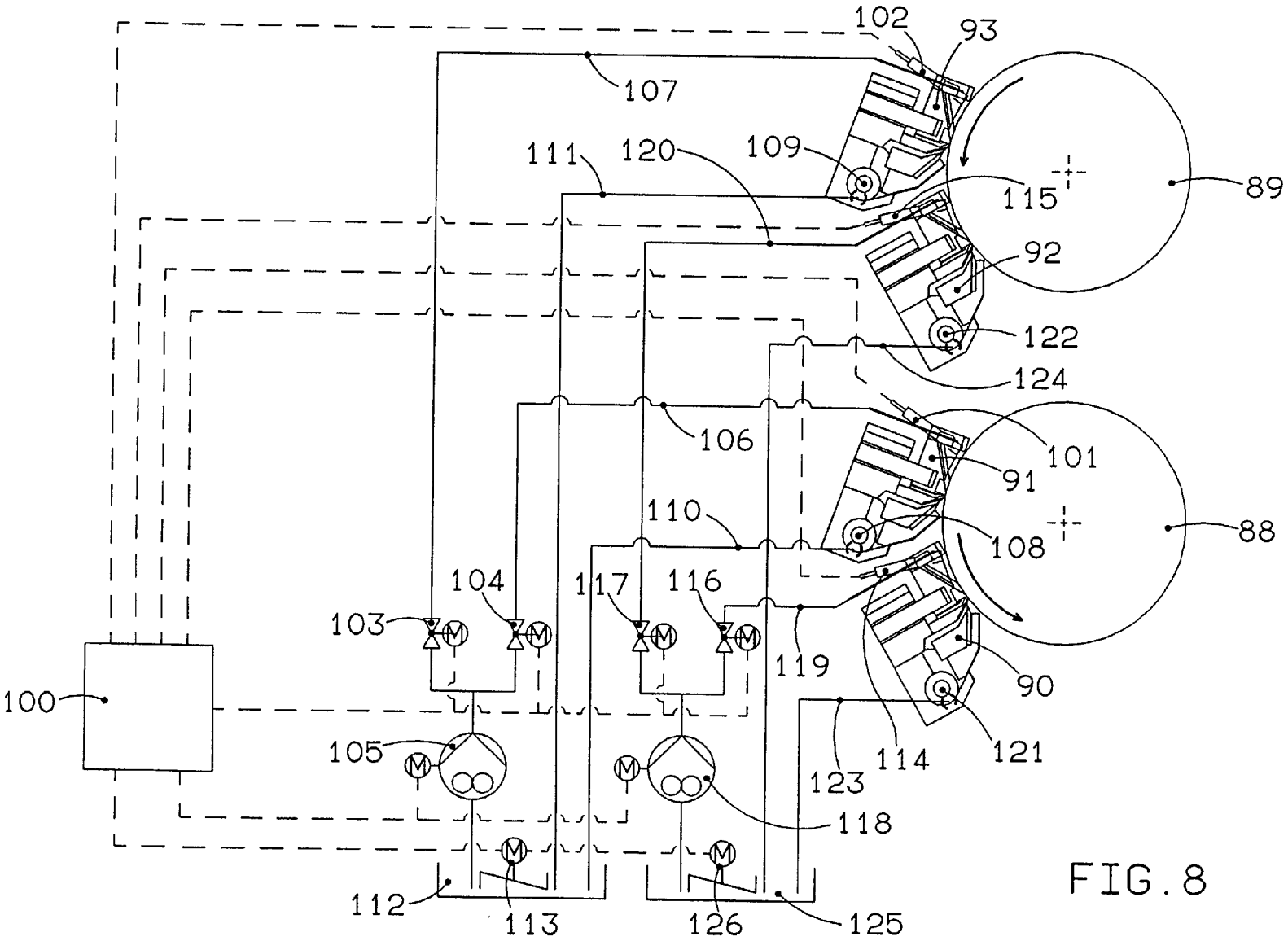
FIG. 8 shows the ink supply system for the doctor blade devices in FIG. 7.

FIG. 8 shows a controlled ink supply for the doctor blade devices 90–93 of a double printing group. The doctor blade devices 91, 93 are for black ink and the doctor blade devices 90, 92 are for colored ink. The processes are controlled by a computer 100. The entire ink supply is based on careful ink treatment, i.e., the ink is to be subjected to as little mechanical stress as possible, for instance, by constant recirculation. When sensors 101, 102 report a need for black ink, valves 103, 104 are opened by the computer 100 and an ink pump 105 is turned on. The pump 105 forces ink through lines 106, 107 into the doctor blade devices 91, 93. When the sensors 101, 102 report an adequate fill level, the pump 105 is turned off and the valves 103, 104 are closed. As described, the returning ink is fed via conveyor screws 108, 109 and lines 110, 111 into the ink container 112. For ink mixing, a stirring unit 113 can be switched on as desired.

The system for colored ink is constructed similarly. After a message from sensors 114, 115, valves 116, 117 are opened and an ink pump 118 is turned on in response to signals from the computer 100. Ink is supplied to the doctor blade devices 90, 92 through lines 119, 120. When a suitable fill level is reached, the ink pump 118 is turned off and the valves 117, 116 are closed. The wiped-off ink is returned via conveyor screws 121, 122 and lines 123, 124 to the ink tank 125, where it is mixed, as desired, by means of the stirring unit 126.

The invention is not limited by the embodiments described above which are presented as examples only but can be modified in various ways within the scope of protection defined by the appended patent claims.

What is claimed is:

1. A doctor blade device for filling depressions in a cylinder of a printing machine with a fluid, comprising:

ink application means;

a fluid conveyance system connected to the application means;

a working blade arranged after the application means in a rotational direction of the cylinder, the application means including a chamber doctor which connects with a removal space defined by the working blade, the chamber doctor being movable away from the cylinder independently of the working blade; and a carrier removably mounted on a support, the chamber doctor being mounted on the carrier, the working blade being mounted to the support, the chamber doctor being removable from the cylinder so as to allow fluid to flow out of the application means, the working blade being in contact with the cylinder when the chamber doctor is removed.

2. A doctor blade device as defined in claim 1, and further comprising a collection basin, the working blade being positioned negatively on the cylinder at a slight distance from the first doctor blade so as to divert wiped-off fluid to the collection basin.

3. A doctor blade device as defined in claim 1, and further comprising working cylinder means for positioning the working blade onto and away from the cylinder.

4. A doctor blade device as defined in claim 1, wherein the application means is configured to be moveable in a longitudinal direction of the cylinder out of the cylindrical surface region of the cylinder.

5. A doctor blade device according to claim 1, wherein the chamber doctor is positioned laterally on the cylinder and has a positively positioned first doctor blade, the application means further including a second doctor blade mounted in front of the first doctor blade in the rotational direction of the cylinder so that the first and second doctor blades form a wedge-shaped first space, the second doctor blade having bores distributed along its length that place a second region defined between the second doctor blade and an outer surface of the cylinder, and the first region in fluid communication.

6. A doctor blade device as defined in claim 5, wherein the first region is operated at a slight overpressure of the fluid, and further comprising a collection basin and overflow duct means that place the second region and the collection basin in fluid communication so that the fluid can flow into the collection basin.

7. A doctor blade device as defined in claim 5, and further comprising working cylinder means operatively connected to the carrier for moving the carrier.

8. A doctor blade device for filling depressions in a cylinder with a fluid, comprising:

ink application means;

a fluid conveyance system connected to the application means;

a working blade arranged after the application means in a rotational direction of the cylinder;

means for moving the application means away from the cylinder independently of the working blade so that the fluid can flow out of the application means when in a position away from the cylinder, the application means including a first doctor blade positioned positively and laterally on the cylinder so as to form a wedge-shaped first region that holds the fluid, the wedge-shaped first region being bordered by the doctor blade and a cylindrical surface of the cylinder;

two sealing plates, each of the sealing plates being moveably arranged to rest against a respective end face of the first doctor blade;

spring force means for pressing the sealing plates toward the respective end face; and bolts arranged so that the sealing plates rest against the bolts and the first doctor blade with a line and point support.

9. A doctor blade device as defined in claim 8, and further comprising two working cylinders, each one of the working cylinders being operatively connected to a respective one of the sealing plates so that the sealing plates can be moved toward and away from the cylinder.

10. A doctor blade device as defined in claim 9, and further comprising flat surface members arranged to guide the sealing plates with play during positioning movement toward the cylinder so as to permit centering of the sealing plates on the surface curvature of the cylinder.

11. A doctor blade device for filling depressions in a cylinder with a fluid, comprising:

ink application means;

a fluid conveyance system connected to the application means;

a working blade arranged after the application means in a rotational direction of the cylinder;

means for moving the application means away from the cylinder independently of the working blade so that fluid can flow out of the application means when in a position away from the cylinder, the application means being configured to be movable in a longitudinal direction of the cylinder out of the cylindrical surface region of the cylinder;

a first holder and a second holder arranged to hold respective sides of the application means and the working blade;

a side wall;

a support member screwed onto the side wall;

a support tube mounted in the side wall and the support member; and a spindle mounted moveably in the support tube, the first holder being moveably arranged on the support tube and the second holder being attached to the spindle.

12. A doctor blade device as defined in claim 11, and further comprising means for oscillating the device, the oscillating means including a working cylinder that rests on the support member and has a piston rod connected detachably to the second holder.

* * * * *